United States Patent [19]

Ishida

[11] 4,037,571

[45] July 26, 1977

[54] MULTI-CYLINDER INTERNAL COMBUSTION ENGINE

[75] Inventor: Yasuhiko Ishida, Susono, Japan

[73] Assignee: Toyota Jidosha Kogyo Kabushiki Kaisha, Toyota, Japan

[21] Appl. No.: 697,478

[22] Filed: June 18, 1976

[30] Foreign Application Priority Data

Mar. 9, 1976 Japan ..... 51-024571

[51] Int. Cl.[2] ..... F02B 75/08; F02M 13/04; F02B 75/20

[52] U.S. Cl. ..... 123/52 R; 123/1 R; 123/52 M; 123/59 R; 123/59 PC; 123/198 F; 123/148 DS; 123/DIG. 8; 261/41 B; 261/41 C; 261/41 R

[58] Field of Search ..... 123/127 R, 119 R, 121, 123/52 R, 52 M, 52 MV, 59 R, 59 PC, 198 F, DIG. 8, 1, 148 PS; 261/41 B, 41 C, 41 R, 23 A, DIG. 60, DIG. 36

[56] References Cited

U.S. PATENT DOCUMENTS

| | | | |
|---|---|---|---|
| 1,318,542 | 10/1919 | Chevrolet | 123/198 F |
| 1,900,470 | 3/1933 | Smith | 23/DIG. 8 |
| 2,085,818 | 7/1937 | Messinger, Jr. | 123/198 F |
| 2,379,288 | 6/1945 | Ericson | 123/198 F |
| 2,954,022 | 9/1960 | Mick | 123/198 F |
| 3,121,422 | 2/1964 | Baker | 123/198 F |
| 3,270,724 | 9/1966 | Dolza | 123/198 F |
| 3,698,371 | 10/1972 | Mitsuyama et al. | 123/198 F |
| 3,765,394 | 10/1973 | Francis | 123/198 F |
| 3,800,752 | 4/1974 | Bruderlin | 123/52 M |
| 3,830,206 | 8/1974 | Asaka et al. | 123/127 |

*Primary Examiner*—Wendell E. Burns
*Attorney, Agent, or Firm*—Stevens, Davis, Miller & Mosher

[57] ABSTRACT

A multi-cylinder engine comprising at least a first cylinder group and a second cylinder group. The first cylinder group is connected to a first intake manifold having a first carburetor with a first throttle valve. The second cylinder group is connected to a second intake manifold having a second carburetor with a second throttle valve. A throttle valve control means is provided for controlling opening degrees of the first and the second throttle valves in response to an extent of depression of an accelerator pedal so that the opening degree of the first throttle valve is larger than that of the second throttle valve when the engine is operating under a partial load, and the first and the second throttle valves are fully opened when the engine is operating under a heavy load.

4 Claims, 9 Drawing Figures

MULTI-CYLINDER INTERNAL COMBUSTION ENGINE

DESCRIPTION OF THE INVENTION

The present invention relates to a multi-cylinder internal combustion engine.

A conventional multi-cylinder internal combustion engine with a carburetor has such a construction that an amount of intake air to be introduced into all cylinders is controlled by a single throttle valve of the carburetor. Contrary to this, there has been proposed an internal combustion engine having a plurality of carburetors, each having a respective throttle valve. In this engine, however, all throttle valves are connected to the accelerator pedal so as to be opened at the same speed when the accelerator pedal is depressed. Generally in an internal combustion engine, the rate of fuel consumption becomes smaller as an opening degree of the throttle valve becomes larger. Even if the carburetor is constructed in such a way that when the engine is operating under a heavy load, that is, when the throttle valve is largely opened, a mixture of relatively excessive fuel is formed in order to increase the developed power of the engine; or that when the engine is operating under a partial load, that is, when the throttle valve is slightly opened, a mixture of relatively excessive air is formed so as to reduce fuel consumption, the rate of fuel consumption generally becomes smaller when the engine is operating under a heavy load compared with the case wherein the engine is operating under a partial load. This indicates that not only an air-fuel ratio of the mixture but also an opening degree of the throttle valve has considerable influence over the rate of fuel consumption. In an internal combustion engine for use in a vehicle, more developed power is required for acceleration, ascending an upward slope and high speed driving. However, when the vehicle is driven on a city street at a lower or a medium speed, less developed power is required, and thus relating to this, the engine is operated under a state wherein the throttle valve is slightly opened. Consequently, there is a disadvantage in that fuel consumption is extremely high.

An object of the present invention is to eliminate the above disadvantage.

According to the present invention, there is provided a multi-cylinder internal combustion engine for use in a vehicle having an accelerator pedal, comprising at least a first cylinder group and a second cylinder group, each cylinder group comprising at least one cylinder, a first and a second intake manifolds connected to said first and second cylinder groups, respectively, a first carburetor having a first throttle valve and mounted on said first intake manifold, a second carburetor having a second throttle valve and mounted on said second intake manifold, a throttle valve control means operable in response to an extent of the depression of the accelerator pedal for opening said first throttle valve to a greater extent than said second throttle valve when the engine is operating under a partial load and for opening said first and second throttle valves to a full extent when the engine is operating under a heavy load, the opening degrees of said first and second valves being continuously changed.

The above-mentioned object of the present invention may be more fully understood from the following descriptions of a preferred embodiment of the invention, together with the accompanying drawings.

DESCRIPTION OF A PREFERRED EMBODIMENT

Figure 1:
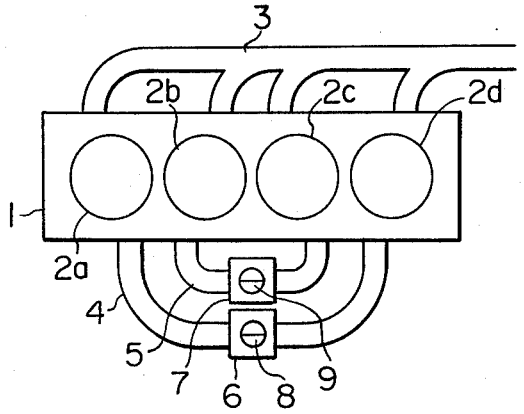
FIG. 1 is a schematic plan view of an internal combustion engine according to the present invention.

Referring to FIG. 1, 1 designates an engine body, *2a*, *2b*, *2c* and *2d* designate cylinders, 3 designates an exhaust manifold, 4 designates an intake manifold for feeding an air-fuel mixture into the cylinder *2a* and *2d*, 5 designates an intake manifold for feeding an air-fuel mixture into the cylinders *2b* and *2c*, 6 designates a carburetor mounted on the intake manifold 4, 7 designates a carburetor mounted on the intake manifold 5, 8 designates a throttle valve of the carburetor 6, and 9 designates a throttle valve of the carburetor 7. The throttle valves 8 and 9 are connected to an accelerator pedal (not shown) so that the throttle valve 8 is opened at a speed different from that of the throttle valve 9 when the accelerator pedal is depressed.

Figure 2:
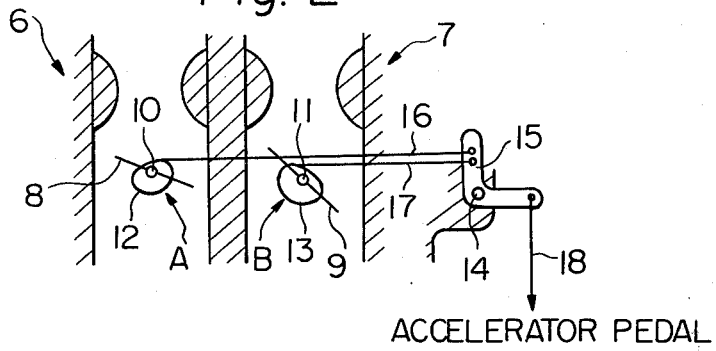
FIG. 2 is a schematic cross-sectional side view of the carburetors shown in FIG. 1.
Figure 3:
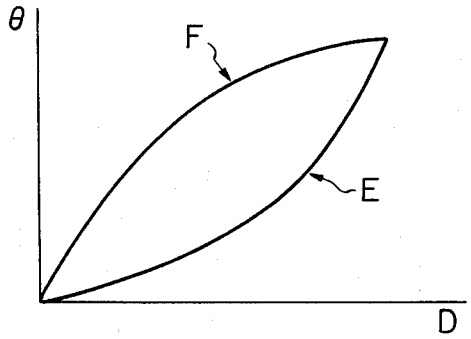
FIG. 3 is a graph indicating the relationship between opening degrees of throttle valves and an extent of the depression of an accelerator pedal.
Figure 6:
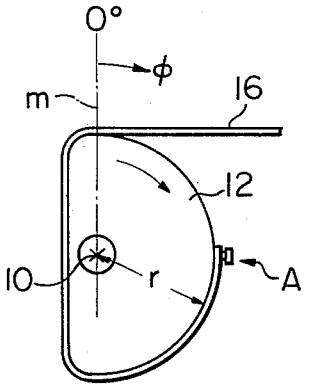
FIG. 6 is an enlarged view of a non-circular cam.
Figure 7:
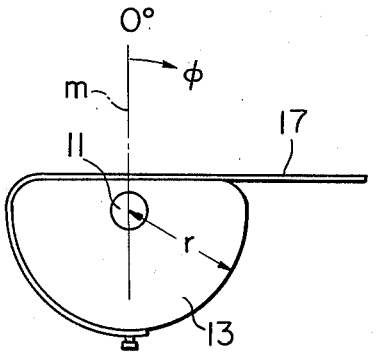
FIG. 7 is an enlarged view of another non-circular cam.
Figure 8:
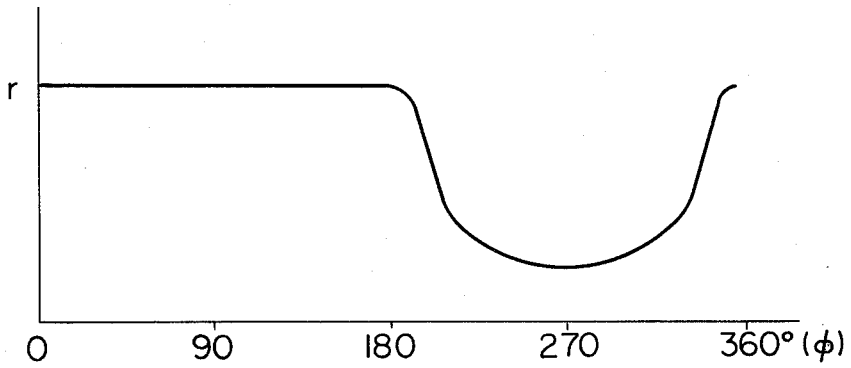
FIG. 8 is a cam diagram of the cam shown in FIG. 6.
Figure 9:
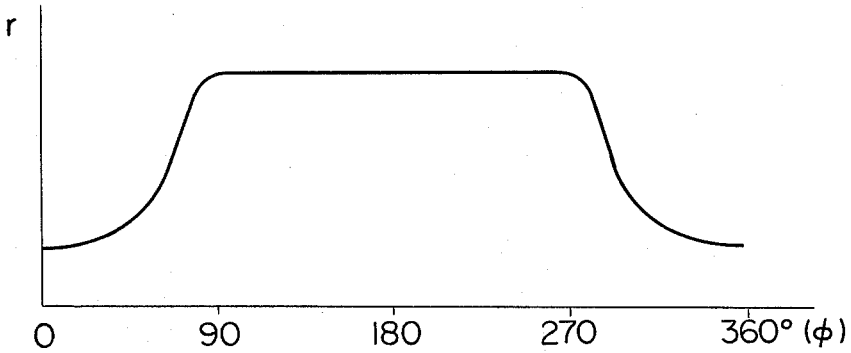
FIG. 9 is a cam diagram of the cam shown in FIG. 7.

FIG. 2 shows an example of a throttle valve opening mechanism. Referring to FIG. 2, non-circular cams 12 and 13 are fixed to the throttle shaft 10 of the throttle valve 8 and the throttle shaft 11 of the throttle valve 9, respectively. Furthermore, there is provided a lever 15 pivotably mounted on, for example, the carburetor 7 by means of a pivot pin 14. Each end of two wires 16 and 17 is connected to one end of the lever 15, and one end of a wire 18 is connected to the other end of the lever 15. The wire 16 is arranged so as to pass around the outer peripheral cam surface of the non-circular cam 12 and is fixed to the non-circular cam 12 at the point A. On the other hand, the wire 17 is arranged so as to pass around the outer peripheral cam surface of the non-circular cam 13 and is fixed to the non-circular cam 13 at the point B. The other end of the wire 18 is connected to an accelerator pedal (not shown). Consequently, when the accelerator pedal is depressed, the lever 15 is turned in a clockwise direction, whereby the throttle valves 8 and 9 are turned at respective speeds determined by the shapes of the non-circular cams 12 and 13, respectively. FIG. 6 shows an enlarged view of the non-circular cam 12, and FIG. 7 shows an enlarged view of the non-circular cam 13. FIGS. 6 and 7 indicate the rotating positions of the non-circular cams 12 and 13 when the throttle valves 8 and 9 are in their closing position. In FIGS. 8 and 9, the ordinates indicate the distance r between the central axis of the throttle shaft 10:11 and the outer peripheral cam surface of the non-circular cam 12:13, and the abscissas indicate the angle $\phi$ between the reference line *m* and the line passing through the central axis of the throttle shaft 10:11 and the point on the outer peripheral cam surface of the cam 12:13, which angle is measured in a clockwise direction from the reference line *m*. That is to say, FIGS. 8 and 9 show cam diagrams of the non-circular cams 12 and 13, respectively. FIG. 3 indicates the relationship between an extent D of depression of the accelerator pedal and an opening degree 0 of the throttle valve. In FIG. 3, curve E indicates an opening degree 0 of the throttle valve 8, and curve F indicates an opening degree O of the throttle valve 9. It will be understood from FIG. 3 that, when the accelerator pedal is depressed, the throttle valve 9 is rapidly opened, while the throttle valve 8 is slowly opened.

Figure 4:
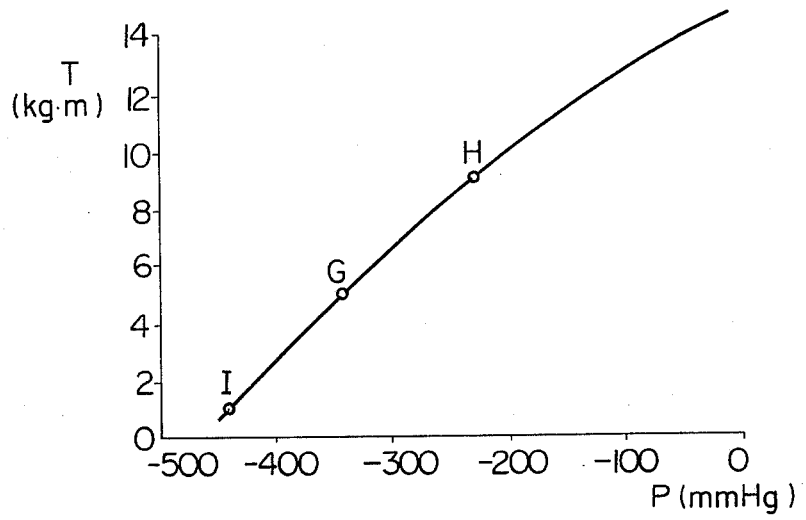
FIG. 4 is a graph indicating the relationship between the intake manifold vacuum and the output torque of the engine.
Figure 5:
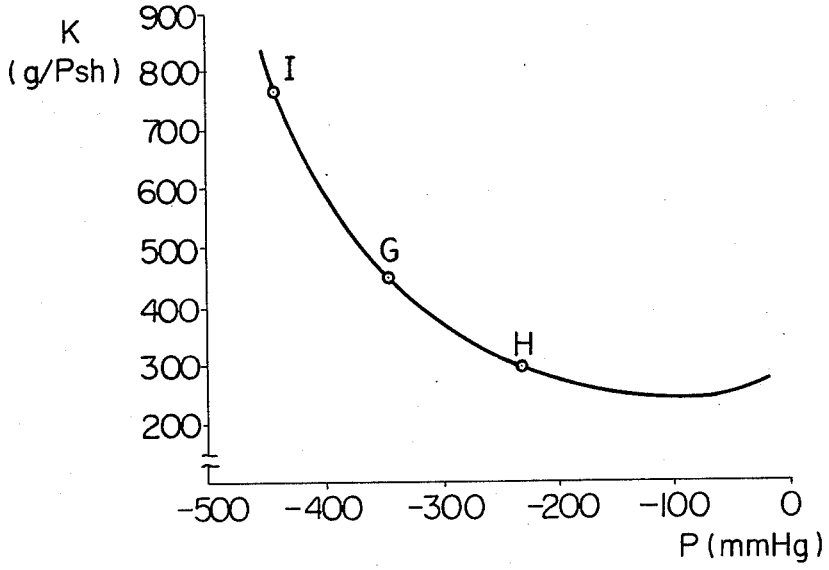
FIG. 5 is a graph indicating the relationship between the intake manifold vacuum and the rate of fuel consumption.

The operation of the engine having two carburetors in which an opening speed of one of the throttle valves is different from that of another throttle valve, is described in the following with reference to FIGS. 4 and 5. FIG. 4 indicates the relationship between the output torque T (kg m) and the vacuum P (mm Hg) in the intake manifold in the case where a four-cylinder engine having a single conventional carburetor is operating at the fixed number of revolutions of 1500 r.p.m. FIG. 5 indicates the relationship between the rate of the fuel consumption K (g/Ps h) and the vacuum P (mm Hg) in the intake manifold in the case where a four-cylinder engine having a single conventional carburetor is operating at the speed of 1500 r.p.m. It is understood from FIGS. 4 and 5 that the output torque T increases and the rate of fuel consumption K decreases as the opening degree of the throttle valve becomes larger; that is, the intake manifold vacuum P becomes smaller. At first, in this engine having a single conventional carburetor, assuming that the output torque of 5 kg m (this state is indicated by the point G in FIGS. 4 and 5) is required. At this time, since the number of revolutions of the engine is 1500 r.p.m., the engine is required to develop 10.5 horsepower (Horse power $= 2\pi \times$ the number of revolutions of an engine $\times$ output torque/ $(60\times75)$). At this time, since the rate of fuel consumption is 450 g/Ps h, as shown in FIG. 5, if the engine continues to be operated for an hour under this condition, the engine consumes a fuel of $450\times10.5=4725$g.

Contrary to this, assuming that the cylinders of the engine are split into two cylinder groups each comprising two cylinders, and one of the cylinder groups is operated under such a state that the throttle valve 9 is largely opened (this state is indicated by the point H in FIGS. 4 and 5), the other cylinder group is being operated under such a state wherein the throttle valve 8 is slightly opened (this state is indicated by the point I). At this time, in this split engine, in order to develop the same horsepower, i.e. 10.5 horsepower as in the engine having a single conventional carburetor, the split engine is required to be operated under such a state that the total output of the torque of both cylinder groups is 5 kg m. For example, one of the cylinder groups is operated so as to develop an output torque of 4.5 kg m (9.0 kg m if it is calculated from the four cylinders) as shown by the point H in FIGS. 4 and 5, while the other cylinder group is operated so as to develop an output torque of 0.5 kg m (1.0 kg m if it is calculated from the four cylinders) as shown by the point I in FIGS. 4 and 5. In this case, one of the cylinder groups operated in the state shown by the point H develops an output torque of 4.5 kg m, i.e. 9.45 horsepower. At this time, the rate of fuel consumption K is 290 g/Ps h as shown in FIG. 5. Consequently, this cylinder group consumes a fuel of $290\times9.45=2740$g per hour. Contrary to this cylinder group, the other cylinder group operated in the state shown by the point I develops an output torque of 0.5 kg m, i.e. 1.05 horsepower. At this time, the rate of fuel consumption K is 765 g/Ps h. Consequently, this cylinder group consumes a fuel of $765\times1.05=803$g per hour. Therefore, the split engine comprising two cylinder groups consumes fuel at the rate of $2740+803=3543$g per hour.

As is aforementioned, the engine having a single conventional carburetor consumes at the rate of 4725 g per hour. Consequently, the split engine can save a quality of fuel equal to $4725-3543=1182$g, that is to say, a fuel saving of 25 percent in comparison with the fuel consumption of the engine having a single conventional carburetor.

As is described hereinbefore, a multi-cylinder engine according to the present invention can save a great deal of fuel and also can develop the same high output power as a conventional engine when the engine is operating under a heavy load since both throttle valves are fully opened at the time of a heavy load.

The present invention can be applied to a multi-cylinder engine except for a four-cylinder engine. Furthermore, in a four-cylinder engine, one of the cylinder groups may comprise a single cylinder, and the other cylinder group may comprise three cylinders. In addition, it is preferable that each of the cylinder groups be provided with a respective ignition system, for example, a respective distributor, whereby ignition timing of the cylinder groups are controlled in response to opening degrees of the corresponding throttle valves.

What is claimed is:

1. A multi-cylinder internal combustion engine for use in a vehicle having an accelerator pedal, comprising:

at least a first cylinder group and a second cylinder group, each cylinder group comprising at least one cylinder;

a first and second intake manifolds connected to said first and second cylinder groups, respectively;

a first carburetor having a first throttle valve and mounted on said first intake manifold;

a second carburetor having a second throttle valve and mounted on said second intake manifold;

a throttle valve control means operable in response to an extent of the depression of the accelerator pedal for opening said first throttle valve to a greater extent than said second throttle valve when the engine is operating under a partial load and for opening said first and second throttle valves to a full extent when the engine is operating under a heavy load, opening degrees of said first and second valves being continuously changed.

2. A multi-cylinder internal combustion engine as recited in claim 1, wherein said throttle valve control means comprises a first non-circular cam connected to said first throttle valve, a second non-circular cam connected to said second throttle valve, a first wire passing around an outer peripheral cam surface of said first cam, one end of said first wire being connected to said first cam, and a second wire passing around an outer peripheral cam surface of said second cam, one end of said second wire being connected to said second cam, the other ends of said first and second wires being connected to the accelerator pedal.

3. A multi-cylinder internal combustion engine as recited in claim 2, wherein the profile of each of said first and second cams comprises a part of a circle and a chord.

4. A multi-cylinder internal combustion engine as recited in claim 1, wherein said engine further comprises a first distributor for controlling the ignition timing of said first cylinder group in response to change in vacuum in said first intake manifold and a second distributor for controlling the ignition timing of said second cylinder group in response to change in vacuum in said second intake manifold.

* * * * *